United States Patent [19]

Yogo

[11] Patent Number: 4,552,006

[45] Date of Patent: Nov. 12, 1985

[54] BENDING APPARATUS

[76] Inventor: Teruaki Yogo, 4423 aza-Johnoh, Ohaza-Ohmori, Moriyama-ku, Nagoya-shi, Japan

[21] Appl. No.: 509,087

[22] Filed: Jun. 29, 1983

[30] Foreign Application Priority Data

Feb. 25, 1983 [JP] Japan ..... 58-31135

[51] Int. Cl.[4] ..... B21D 7/04

[52] U.S. Cl. ..... 72/149

[58] Field of Search ..... 72/149, 153, 154, 155, 72/156, 159, 450

[56] References Cited

U.S. PATENT DOCUMENTS

| | | | |
|---|---|---|---|
| 1,135,875 | 4/1915 | Brinkman | 72/159 X |
| 2,871,909 | 2/1959 | Bower | 72/321 |
| 4,236,398 | 12/1980 | Schwarze | 72/157 |
| 4,249,407 | 2/1981 | Fogleman | 72/159 X |

FOREIGN PATENT DOCUMENTS

| | | | |
|---|---|---|---|
| 314226 | 9/1919 | Fed. Rep. of Germany | 72/149 |
| 2642942 | 3/1978 | Fed. Rep. of Germany | 72/149 |
| 102760 | 10/1962 | Netherlands | 72/159 |

*Primary Examiner*—E. Michael Combs

*Attorney, Agent, or Firm*—William A. Drucker

[57] ABSTRACT

A shaft is rotatably mounted to one end of a frame, and is provided with a work support and a bender arm. The bender arm is provided with a clamp means adapted to be moved radially of the work support. A bar-shaped material is tightly held by and between the work support and the clamp means, and the bender arm is turned on the rotatable shaft so that the material is bent along a recessed periphery of the work support while being supported thereby.

4 Claims, 9 Drawing Figures

BENDING APPARATUS

BACKGROUND OF THE INVENTION

1. Field of the Invention

This invention relates to apparatus for bending bar-shaped, plastically-workable materials such as metal rods and pipes.

2. Description of the Prior Art

Heretobefore the operation of bending bar-shaped materials has been made manually with the help of a pair of spaced-apart studs projecting from a base plate. That is, one end of the material is positioned between the studs, and its other end is manually turned about the studs to bend the material. Among the problems of such a conventional technique is that the material often cannot be bent in exact accordance with the predetermined radius of curvature or at the exact predetermined position.

In order to solve such prior art problems has been proposed a bending apparatus wherein a bender means is coupled to a rotatable shaft having a sprocket. A chain is fitted onto the sprocket and an output shaft of a geared motor. The bender means has a circular shape, and a material to be bent is pressed against the periphery thereof with a suitable clamp means and the shaft is rotated to bend the material along said periphery. In such a proposal, however, if a large-sized sprocket is used, the forward portion of the work that moves as the bender means is rotated (portion of the work that is forward of its portion held by the presser means and clamp means) may strike against the sprocket to prevent the bending operation. Such a situation is often encountered where a bar-shaped material is to be successively bent at a number of sections thereof in its lengthwise direction. Furthermore the shaft of the apparatus constructed as above must be thick. The rotable shaft is subject to large tortional stress when the torque applied to the sprocket is transmitted through the rotatable shaft to the bending support. The rotable shaft must have a thickness sufficient to withstand such large tortional stress. When a thick rotable shaft is used, the bending work support to be mounted on the rotable shaft must be of a large diameter suitable for mounting on the thick rotable shaft. A bending work support of small diameter can not be used.

Apparatus of the following construction has been devised to eliminate the problem in which the sprocket obstructs the bending operation against the work. To one end of the rotable shaft is connected one end of a lever, to the other end of which is connected a driving means such as a hydraulic cylinder through a linkage. With the apparatus of this type, bending processes can be performed with ease on slender work successively along the longitudinal direction thereof at two, three or more portions, since the apparatus lacks the obstructive sprocket. During the bending process, the driving force of the driving means is conveyed to the rotable shaft through the cylinder and the lever, and further to the bending work support via the rotable shaft. Accordingly, a rotable shaft is necessary which is sufficiently thick to withstand the large tortional stress as in the case of the apparatus with the sprocket. Consequently a usable bending work support is limited to one of a large diameter which is adaptable to the thick rotable shaft as described previously.

SUMMARY OF THE INVENTION

The present invention aims to obviate these prior art problems.

According to the invention, a material to be bent is tightly held, at a portion thereof, by and between the periphery of a circular work support and a clamp means and a bending operation is made by moving the work support and the clamp means about a shaft supporting the work support so that the material is bent by and along the periphery or bending surface of the work support so as to be given exactly the same curvature as the bending surface thereof.

According to another aspect of the invention, a bar-shaped material can be successively bent at a number of portions thereof in the above-mentioned manner, without encountering any difficulty, even if the distances between the portions to be bent are relatively small, so that the material may be bent in a delicately skillful manner.

The foregoing second advantage of the invention is obtained by using the following construction: A bender arm is pivotally connected to the above-mentioned shaft, and said clamp means is located in conjunction with the bender arm. Before starting the bending operation, the bender arm is positioned at practically right angles to the direction in which to feed the material, so that the entire space in front of the bending mechanism (comprising the work support and bender arm), namely, that into which each portion of the material to be bent will project, may be made free from any obstruction that would prevent the bending operation. In addition, during bending operation, the free space may be utilized to allow the bent portion of the material to move freely therein. Therefore, the successive operation of bending a bar-shaped material at a number of portions thereof may be made, regardless of how long its portions between those to be bent is, while allowing the already-bent portion or portions to move freely in said space. Thus, no difficulty is encountered in bending the different portions of the material exactly along the bending surface of the work support. It is a feature of the present invention that work can be processed to be bent with a bending work support of large diameter but also with a bending work support of small diameter to bend work to a small radius of curvature.

In apparatus according to the present invention, the bending work support is mounted on the support shaft, the base portion of the arm is connected to the support shaft, the arm is provided with a clamping means and the work is clamped by the bending work support and the clamp means. The driven point, on which the driving force for bending is exerted by the driving means, is set on the arm. When a force is exerted on the driven point, the arm rotates around the support shaft and the clamping means receives the driving force directly around the support shaft. In this instance the clamping means clamps the work between itself and the bending work support. Thus the work is bent as the clamp means rotates. In this process of operation, the support shaft need not convey any torque, i.e. the support shaft is not subject to any large tortional stress. Thus the support shaft need not be so thick (it may be relatively thin so long as it can support mechanically the bending work support and the arm). If the support shaft is thin, a bending work support of a large diameter can be mounted or one of a small radius can also be mounted.

Therefore the work can be bent not only to a large radius of curvature but also to small one.

Still further feature of the invention is that the bender arm is provided with a driven point for receiving a force to operate the arm. This enables the driven point of the arm to be located at a relatively long distance from said shaft while at the same time keeping intact the above-mentioned free large space in front of the bending mechanism. When the driven point of the arm is located at such a distance, the driven point is only required to receive a relatively smaller force for the bending operation.

Other objects and advantages of the invention will become apparent during the following discussion of the accompanying drawings.

DETAILED DESCRIPTION OF THE PREFERRED EMBODIMENT

Figure 1:
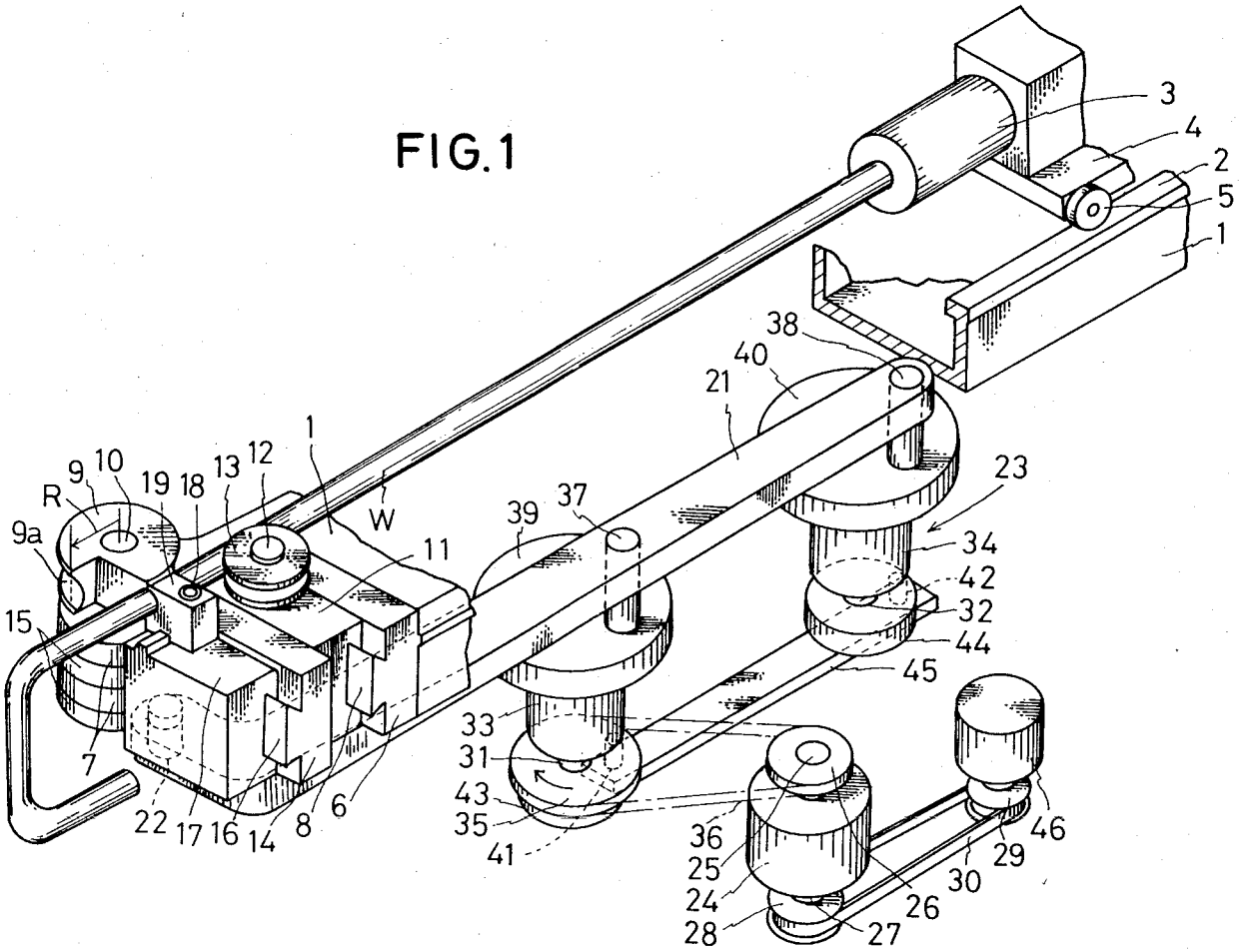
FIG. 1 is a partly-broken perspective view of a bending apparatus according to the invention which illustrates a bending mechanism thereof prepared for bending operation.

Referring now to the drawings, and to FIG. 1 in particular, a bending apparatus according to the invention includes a frame 1 having a pair of rails 2 on its upper surface which extend in the lengthwise direction of the apparatus. On the rails 2 is located a carriage means 4 which is provided with wheels 5 to allow the carriage 4 to move along the rails 2 and to which is coupled a chuck 3 to hold a work W. The carriage means 4 is adapted to travel automatically, as required, by means of an advance mechanism (not shown). Also, the carriage means 4 is provided with a built-in chuck rotator (not shown) which serves to turn the work W held by the chuck 3. Although the work W to be bent by the apparatus is illustrated in the form of a round bar in the drawings, bar-shaped materials with different cross sections may be bent thereby. Numeral 6 designates a block support secured to the forward end of the frame 1 and provided with a pair of shaft supports 7 at the leftmost end (as viewed from the front of the apparatus) of the front side of the block support 6. Also on the front side of the block support 6 is formed a trapezoid-shaped block guide 8 which extends crosswise of the rail direction. A shaft 10 is rotatably connected to and supported by the supports 7 of the block support 6 (through bearings, not shown). A block 11 is dovetailed with the guide section 8 of the support 6. The block 11 is slidable along the guide section 8, i.e. adapted to be moved therealong over a certain distance by a hydraulic cylinder (not shown) built into the block support 6. A shaft 12 is fixedly mounted to the slidable block 11, and a circular presser means 13 is rotatably coupled to the fixed shaft 12. The presser means 13 is recessed at its periphery to provide a curved surface to press against the periphery of the work W. Also, the presser means can be removed from the shaft 12 so as to replace it with another one of desired outside diameter.

Figure 2:
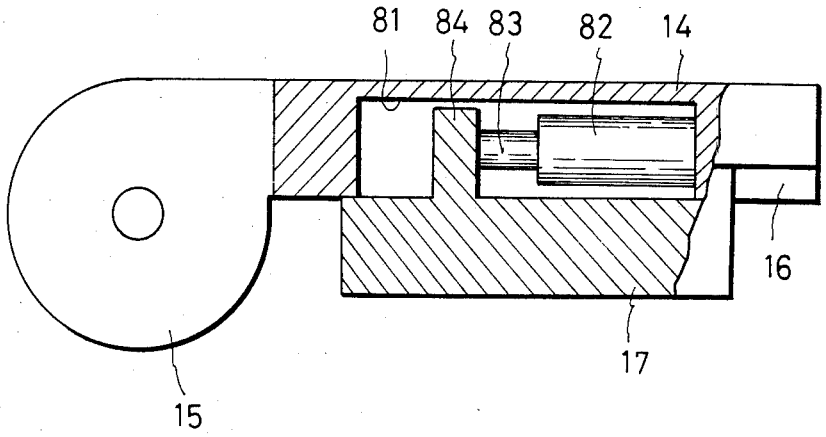
FIG. 2 is a partly section plan view of a portion of a bender arm employed in the apparatus of FIG. 1.

A circular work support 9 is coupled to the rotatable shaft 10. The work support 9 has a radius of curvature R and also is recessed at its periphery so as to provide a curved support or bending surface **9*a* to virtually conform to the periphery of the work W. The work support 9 can also be removed from the shaft 10 to replace it with another one of desired radius of curvature or curved surface 9*a*. In front of the block 11 is located a bender arm 14 shaped similarly to the block support 6 and having a pair of shaft supports 15 connected to the shaft 10. As with the block support 6, the bender arm 14 is provided with a trapezoid-shaped block guide 16 at its front side which projects forward therefrom and extends substantially radially relative to the shaft 10. A block 17, similar to the preceding one 11, is dovetailed with the guide section 16 of the bender arm 14. As with the block 11, the block 17 is slidable along the guide section 16, i.e. adapted to be moved therealong over a certain distance by a hydraulic cylinder 82 (FIG. 2) built into the bender arm 14. As shown in FIG. 2, the bender arm 14 is provided with a recess 81 in which the cylinder 82 having a piston rod 83 is located with its body secured to the inner surface of the arm 14. The block 17 projects into the recess 81 at 84, and one end of the piston rod 83 is connected to the projection 84. Thus, the block 17 can be moved along the guide section 16 in indicated directions by operating the piston rod 83. The sliding of the block 11 along its support 6 is allowed by a similar mechanism. Referring again to FIG. 1, a clamp means 19 is bolted to the slidable block 17 at 18. The clamp means 19 is recessed at one side thereof so as to provide a curved surface corresponding to the curved bending surface 9*a* of the work support 9, thereby enabling the clamp means 19 to hold the work W tightly together with the work support 9. Numeral 21 designates a drive link which is pivotably connected, at its one end, to the bender arm 14 by means of a drive pin 22**.

If the work W to be bent hereby has a cross section other than a circle, the presser means 13, work support 9, and clamp means 19 may be all replaced with those contoured to fit such a different work.

Figure 4:
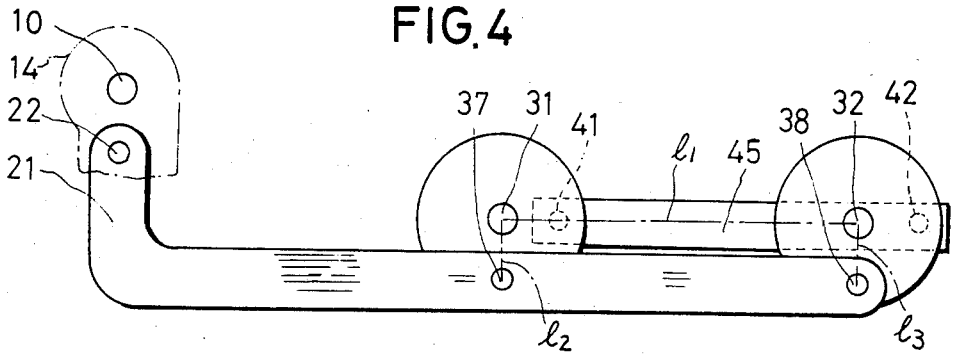
FIG. 4 is a plan view of a drive mechanism employed in the apparatus of FIG. 1 which shows the drive mechanism when the apparatus is in the condition of FIG. 1.
Figure 5:
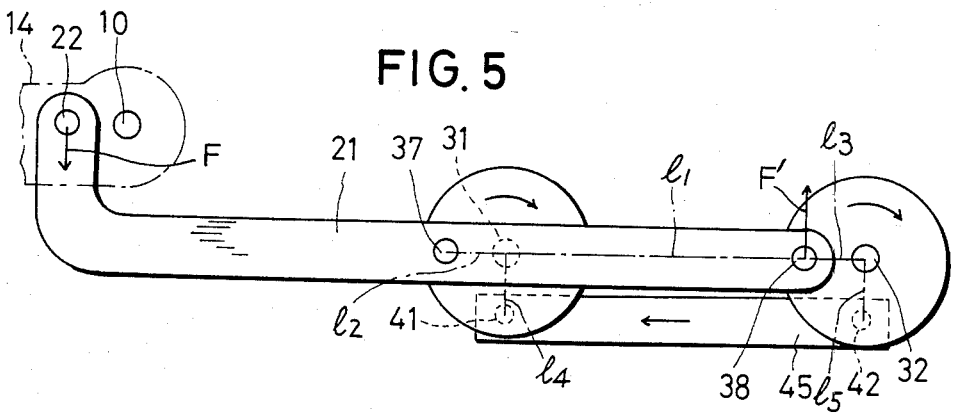
FIG. 5 is a plan view of the drive mechanism when the apparatus is in the condition of FIG. 3.

Numeral 23 designates a mechanism connected to the drive link 21 for imparting a bending force to the driven point of the arm 14, i.e., drive pin 22, through the link 21. This drive mechanism 23 includes components designated by numerals 24 to 46: A drive motor 24 has a driving shaft 25 and a control shaft 27 which are provided with a sprocket 26 and a belt pulley 28, respectively. The control shaft 27 is adapted to adjust the rotation amount of the drive motor 24. The drive motor 24 is connected to a bending-operation control motor 46 by means of a belt 30 which is fitted onto the pulley 28 of the motor 24 and the pulley 29 of the control motor 46. A computer-controlled pulse motor is preferably used as the control motor 46 in order to achieve a higher degree of control accuracy. Numerals 31 and 32 designate shafts which are rotatably supported by bearings 33 and 34, respectively. A sprocket 35 is coupled to the shaft 31, and a chain 36 is fitted onto the sprockets 35 and 26. Disks 39 and 40 are securely fastened to the upper ends of the rotatable shafts 31 and 32, respectively. First crankpins 37 and 38 are mounted on the disks 39 and 40, respectively, in eccentric positions relative to those disks, and are also connected to the middle and rear portions, respectively, of the drive link 21. The crankpins 37 and 38 are located relative to the shafts 31 and 32, respectively, in such a manner that the positional relationships between pin 37 and shaft 31 and between pin 38 and shaft 32 are at all times exactly the same as that between drive pin 22 and shaft 10; to be more precise, as best illustrated in FIGS. 4 and 5, not only the imaginary horizontal lines connecting the axes of the pin 37 and the shaft 31 and those of the pin 38 and the shaft 32 are always parallel with that connecting the axes of the drive pin 22 and shaft 10, but also the crankpins 37, 38 are located at the same distances from the shafts 31, 32, respectively, as the drive pin 22 is spaced apart from the shaft 10. Numerals 43 and 44 designate disks fastened securely to the lower ends of the rotatable shafts 31 and 32, respectively. Second crankpins 41 and 42 are mounted on the disks 43 and 44, respectively, in eccentric positions relative to those disks. The positional relationship between the lower crankpin 41 and the upper one 37 relative to the shaft 31 is such that the two pins 41 and 37 are located 90 degrees spaced apart from each other. Also, the positional relationship between the crankpins 42 and 38 (relative to the shaft 32) is the same as above mentioned. In addition, the distance between pin 41 and shaft 31 is the same as that between pin 42 and shaft 32. The crankpins 41 and 42 are connected to each other by means of an interlock link 45. It may be readily seen that the link 45 as well as disks 43 and 44 is rotated when the shafts 31 and 32 are rotated.

Figure 3:
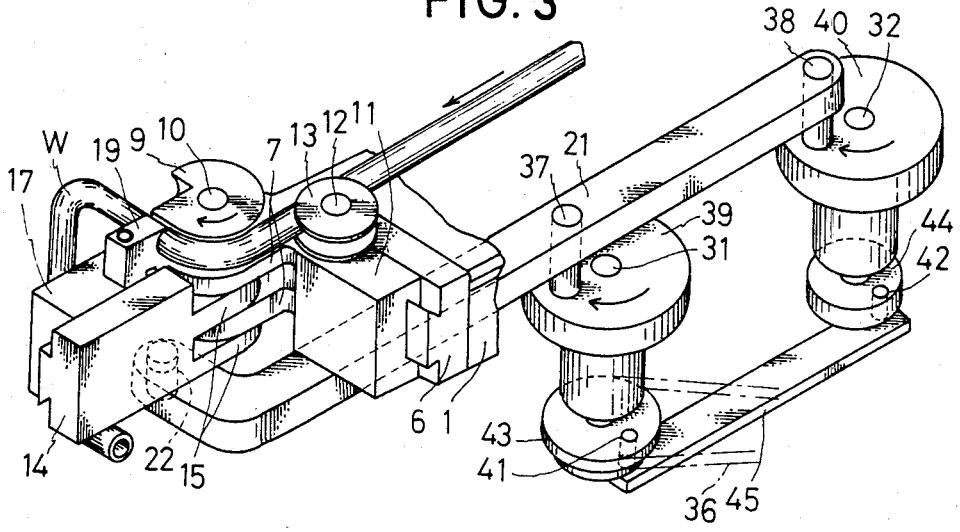
FIG. 3 illustrates the apparatus of FIG. 1 in bending operation.

In operation, the work W is bent to the radius of curvature R, as follows: First, the slidable blocks 11 and 17 are retracted, i.e. positioned away from the work support 9. In this condition, the work is positioned between the work support 9 and the clamp means 19 and held with the chuck 3 at its one end. Then the chuck carriage 4 is manually or automatically moved such a distance that one end of the portion of the work to be bent is exactly located between the work support 9 and the clamp means 19. This is followed by sliding the blocks 11 and 17 towards the work so as to press the presser means 13 and the clamp means 19 against the work and so that the work is tightly held by the work support 9 and the clamp means 19, both having the recessed peripheries to closely fit the periphery of the work. In this condition (FIG. 1), the control motor 46 is operated according to the desired bending amount of the work so as to determine the amount of rotation of the drive motor 24. Then the drive motor 24 is rotated to cause the shaft 31 to rotate, through the sprocket 26, chain 36, and sprocket 35, in a direction indicated by arrow of FIG. 1, so that the crankpins 37 and 41 are rotated in the same direction by the angles determined by said predetermined amount. Simultaneously this operation rotates the crankpins 38 and 42, associated with the shaft 32, through the drive link 21 and the link 45 in the same direction and by the same angle as the crankpins 37 and 41. Thus, the drive link 21 makes an arcing motion, without changing its direction, with the distance between the shaft 31 and the crankpin 37 and that between the shaft 32 and the crankpin 38 as reference radii of the motion, so that the drive pin 22 is caused to move around the shaft 10 so as to turn the bender arm 14 in a pivotal manner by the angle determined by said predetermined amount of rotation of the drive motor 24 (FIG. 3). By this operation, the clamp means 19 and the work support 9 are turned and rotated, respectively, in the direction indicated by arrow of FIG. 3, while holding the work tightly. When the clamp means 19 and work support 9 are thus operated, the work is accordingly moved forward (as indicated in FIG. 3) (with the chuck carriage 4 moved forward along the rails 2) and the portion of the work immediately backward of its portion held by the clamp means 19 and support 9 is bent by the bending surface 9*a* of the support 9 while being supported thereby.

Figure 9:
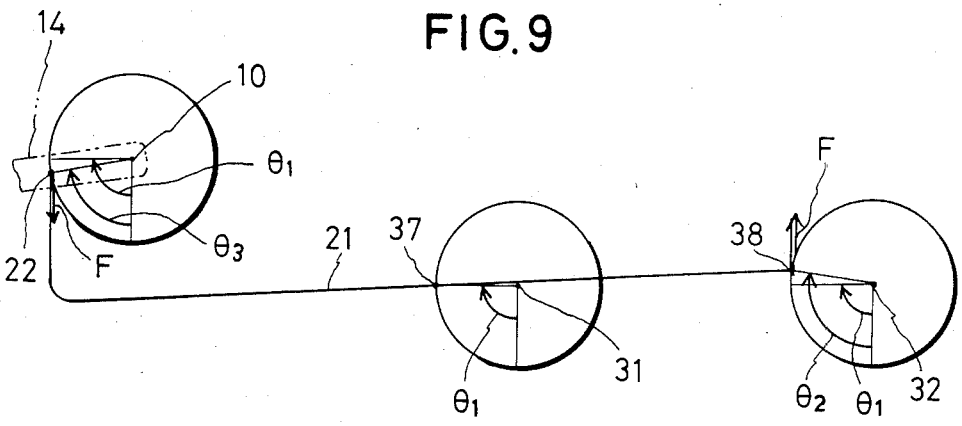
FIG. 9 illustrates how the apparatus herein is operated if a link shown in the foregoing various figures is not employed.

The foregoing bending operation may be started from the condition shown in FIG. 4, in which the imaginary horizontal line $l_1$ connecting the axes of the shafts 31 and 32 makes approximately right angles with that $l_2$ connecting the axes of the shaft 31 and crankpin 37 and that $l_3$ connecting the axes of the shaft 32 and crankpin 38. In such an operation, when the shafts 31 and 32 have been rotated approximately 90 degrees, all foregoing lines $l_1$, $l_2$, and $l_3$ are brought into one straight line as illustrated in FIG. 5. Simultaneously, however, the pin 22 is subjected to a reaction F in a direction indicated by an arrow of FIG. 5, which reaction has been induced by the resistance of the work to the bending operation. This reactive force F is transmitted to the crankpin 38 by the action of the link 21, pivotably connected to the crankpin 37, as a lever, so that a force F′ is exerted to the crankpin 38. The resultant force F′ would raise the following problem without the link 45: For the accurate operation of bending the material, the crankpins 37, 38 and the drive pin 22 all must be turned by the same angles determined by the rotation of the shaft 31. If no link such as 45 were provided, however, the rotation of the shaft 31 for the purpose of turning all these pins by the same angle, such as one indicated by $\theta_1$ in FIG. 9, would result in only the crankpin 37 being moved by that angle, but the other two pins 38 and 22 being turned to unexpected positions, such as those indicated by angles $\theta_2$ and $\theta_3$, respectively (FIG. 9). The reason for this is that the foregoing reactive force F pushes the drive pin 22 back to the smaller-angle ($\theta_3$) position and the foregoing resultant force F′ turns the crankpin 38 to the greater-angle ($\theta_2$) position because the crankpin 38 itself cannot resist the resultant force F′ (as exerted in indicated direction of FIG. 9). That is, the crankpin 38 cannot prevent the drive pin 22 from being pushed back by the reactive force F. Thus, when the shaft 31 is rotated a desired angle, the bender arm 14 is turned by a different angle so that the material W cannot be bent at the required angle, i.e. the same one as the rotation angle of the shaft 31. However, since the embodiment herein of the invention is provided with the link 45, such a problem is not raised, but the work can be bent by the exact angle as predetermined. That is, the force F′ will further rotate the shaft 32 clockwise independently of the shaft 31, but without success because of the following mechanism: That is, the foregoing imaginary horizontal line $l_1$ connecting the axes of the shafts 31 and 32 also makes, in the condition of FIG. 5, approximately right angles with the line $l_4$ connecting the axes of the shaft 31 and pin 41 and the line $l_5$ connecting the axes of the shaft 32 and pin 42. In addition, the crankpins 41 and 42 are connected to each other by the link 45. Thus, the further rotation of the shaft 32 by the resultant force F′ is prevented by the link 45, so that the shafts 31 and 32 are never allowed to rotate except at exactly the same angles. Therefore, the bender arm 14 connected to the drive link 21 is allowed to turn by the exact predetermined angle, i.e. the same one as the rotation angle of the shaft 31, thereby bending the work at that exact angle.

The above-mentioned construction of bending apparatus may be modified by directly connecting the shaft 10 to the shaft support 7 of the block support 6 and rotatably connecting the work support 9 and bender arm 14 to the shaft 10.

Also, the crankpins 37, 41 and 38, 42 may be located in such positions that the pins 37 and 41 make any angle other than 90 degrees (and excepting around 0 and 180 degrees) relative to the shaft 31 and the pins 38 and 42 also make any angle other than 90 degrees (and excepting around 0 and 180 degrees) relative to the shaft 32, provided that such other angles made by the pins 37, 41 and by the pins 38, 42 must be the same as each other.

Figure 6:
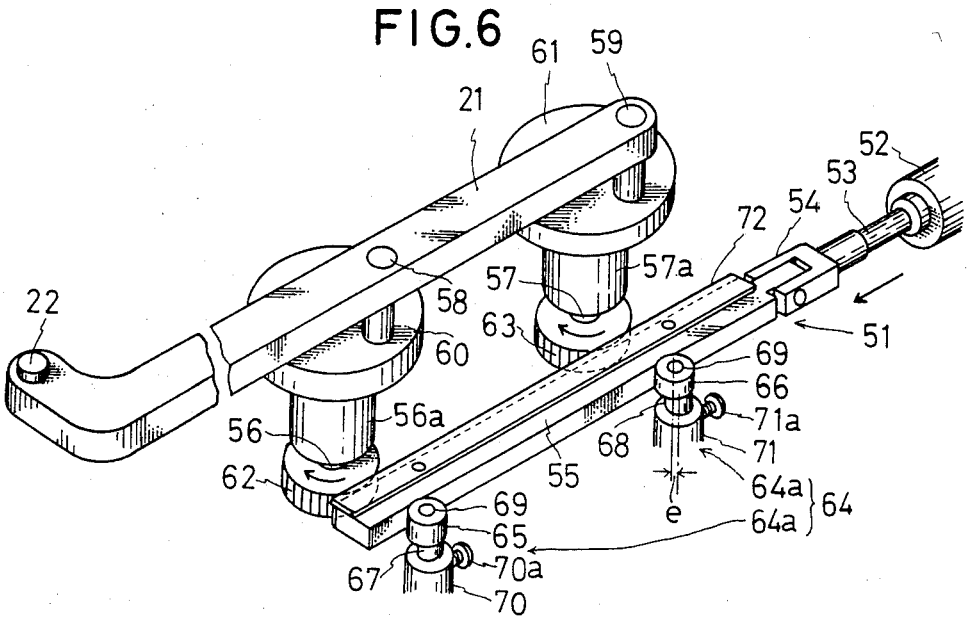
FIG. 6 is a perspective view of another form of drive mechanism which may be employed in the apparatus.
Figure 7:
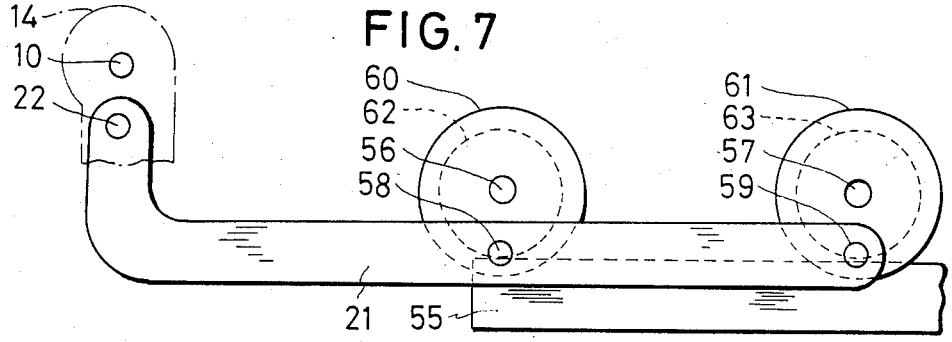
FIGS. 7 and 8 are plan views of the drive mechanism of FIG. 6 similar to FIGS. 4 and 5.
Figure 8:
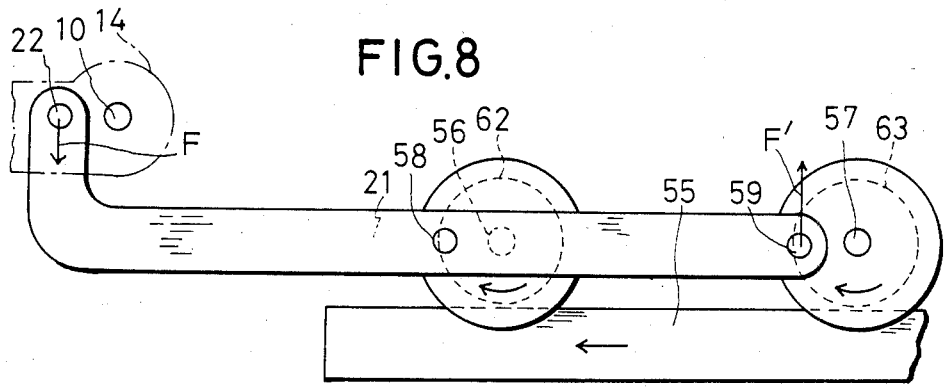

Referring to FIGS. 6, 7, and 8, the bending apparatus herein may be operated by using a drive mechanism 51 instead of 23 shown in FIGS. 1 to 5. In the embodiment of FIGS. 6 to 8, the details of construction other than the drive mechanism 51 are fundamentally the same as the preceding embodiment, and the similar parts are designated by the same reference numerals. The drive mechanism 51 is so constructed as to function in the same way as the preceding one 23. That is, the drive mechanism 51 is adapted to move the link 21 in such a manner that the link 21 traces circular arcs with the distance between the axes of the drive pin 22 (point of the link 21 connected to the arm 14) and of the shaft 10 as a reference radius, and is adapted to keep the link 21 in its given direction wherever the link 21 is located during arcing motion. These functions of the drive mechanism 51 are enabled by the following construction: The drive mechanism 51 includes components designated by numerals 52 to 72 (FIG. 6). Numeral 52 designates a hydaulic drive cylinder having a piston rod 53. A drive rack 55 is connected, at its one end, to the rod 53 by means of a fastener 54. As with the preceding embodiment, shafts 56 and 57 are rotatably supported by bearings **56*a* and 57*a*, respectively, and disks 60 and 61 are coupled to the upper ends of the shafts 56 and 57, respectively. Crankpins 58 and 59 are mounted on the disks 60 and 61, respectively, in eccentric positions relative to those disks. The positional relationships between shaft 56 and pin 58 and between shaft 57 and pin 59 are the same as those between shaft 31 and pin 37 and between shaft 32 and pin 38, respectively, of the preceding embodiment. The crankpins 58 and 59 are rotatably connected to the middle and rear portions, respectively, of the drive link 21. Gears 62 and 63 of the same sizes are secured to the lower ends of the crankshafts 56 and 57, respectively. The gears 62 and 63 are meshed with the forward end and rear portion, respectively, of the drive rack 55. Along the rack 55 is disposed a means 64 for controlling the backlash between the gears 62, 63 and the rack 55, which means 64 includes a pair of adjusters 64*a*, 64*a* located opposite to the gears 62, 63, respectively, with the rack 55 therebetween. Since the adjusters 64*a*, 64*a* have exactly the same constructions and functions, only one of them (right-hand one in FIG. 6) will now be described. Numeral 71 designates a bearing secured to a frame (not shown) and rotatably supporting a shaft 68. The bearing 71 has a screw 71*a* to enable the shaft 68 to be fixed to the bearing 71 for the purpose of making the shaft 68 unrotatable. A shaft 69 is connected to the upper end of the shaft 68, being located eccentric to the shaft 68 by an amount e. A roller 66 is rotatably coupled to the shaft 69, making contact with one side of the rack 55. Each adjuster 64*a* has such a construction. It may be seen that the rollers 65, 66 are moved towards or away from the gears 62, 63, respectively, by rotating the shafts 67, 68, so as to press the rack 55 against the gears 62, 63. Therefore, when an excessive backlash is produced between the gears 62, 63 and the rack 55, the shafts 67, 68 may be rotated by such an angle as required to remove the excess, so that the gears 62, 63 are normally meshed with the rack 55. And when the rack 55 has thus been displaced to such a position as to normally re-engage with the rack 55, the rack 55 can be kept in that position by screwing at 70*a*, 71*a* to make the shafts 67, 68 unrotatable. Numeral 72 designates a guide means attached to the upper surface of the rack 55 and partly contacting the upper surfaces of the gears 62, 63**.

Instead of such a backlash controller 64 of an eccentric-shaft type, any other suitable type of means may be used to achieve the same purpose. For example, a belt-shaped means adjustable in its position may be so located as to contact the rack 55 for the purpose of displacing the rack 55 by inches.

In operation, with a work held by the work support and the clamp means, the drive cylinder 52 is operated to advance the piston rod 53 and therefore the drive rack 55 by such an amount as required for the particular bending operation, so that the gears 62, 63 engaging with the rack 55 are rotated in the same directions and by the same angles as indicated by arrows. By this operation, the shafts 56, 57 are rotated to rotate the crankpins 58, 59 simultaneously in the same directions and by the same angles. Thus, the drive link 21 is caused to make an arcing motion, thereby turning the the bender arm 14 through the drive pin 22 at the predetermined angle, so that the work is bent to the predetermined radius of curvature and angle.

If the foregoing bending operation is started from the condition of FIG. 7, the condition of FIG. 8 is produced when the operation has been made up to 90 degrees (same condition as FIG. 5). In this condition, however, since the gear 63 associated with the shaft 57 is engaged with the rack 55, the previously-mentioned force F′ (referred to in connection with the first embodiment) cannot further rotate the shaft 57 clockwise independently of the other shaft 56. It is to be noted, in addition, that the prevention of further rotation of the shaft 57 can be made with a higher degree of reliability as the backlash or play between the gear 63 and the rack 55 is kept to the smallest degree required. Thus, the shafts 56 and 57 are allowed to rotate in an exactly simultaneous or integral manner, so that the bender arm 14 is turned strictly as predetermined, thus bending the work to the exact predetermined angle.

As many apparently widely different embodiments of this invention may be made without departing from the spirit and scope thereof, it is to be understood that the invention is not limited to the specific embodiments thereof except as defined in the appended claims.

What is claimed is:

1. In bending apparatus comprising:

(a) a support shaft connected to a frame and extending from said frame in the same direction as an article to be bent is fed;

(b) a substantially circular bending die removable coupled to said support shaft and freely rotatable about the axis of said shaft relative to said frame;

(c) a driven bender arm connected to one end of said support shaft and movable about the axis of said shaft relative to said frame and having a drive pin positioned at a distance from one end thereof, said pin being linked to a drive mechanism for receiving a bending force; the improvement in which:

(I) said drive mechanism includes a pair of rotated shafts spaced apart from each other and rotated by drive means;

(II) a pair of first crankpins respectively connected to said shafts, said crankpins being spaced not only the same distance from each rotated shaft as said drive pin is spaced from said support shaft, but also always oriented at the same angle relative to its shaft as that in which said drive pin is angularly oriented relative to said support shaft;

(III) a drive link is connected to said driven point at one end, to one of said crankpins at its other end and to the other crankpin between its ends, said link being mounted for circular movement; and (IV) said drive shafts are interconnected to rotate synchronously.

2. A bending apparatus in accordance with claim 1 further characterized in that:

(a) said drive mechanism is connected to said bender arm at a predetermined point thereon by means of a drive link to drive said arm;

(b) said drive mechanism includes a first shaft rotatable by a drive motor and another rotatable shaft located at a certain distance from said first shaft;

(c) a said first crankpin is connected to each said rotatable shaft, said first crankpin being disposed not only at the same distance from said another shaft as said predetermined point is spaced from said support shaft, but also always oriented at the same angle relative to said another shaft as said predetermined point is angularly oriented relative to said support shaft;

(d) said drive link is connected to said bender arm at its one end, to one of said first crankpins at its other end, and to other one of said first crankpins between its ends, said drive link being mounted for circular motion;

(e) a second crankpin is further connected to each rotatable shaft of said drive mechanism, said first and second crankpins connected to one of said rotatable shafts oriented at the same angle relative to its shaft as said first and second crankpins connected to the other one of said rotatable shafts are angularly oriented relative to said other one of said shafts; and (f) said second crankpins are connected to each other by means of an interlock link.

3. A bending apparatus in accordance with claim 1 further characterized in that:

(a) said drive mechanism is further provided with a cylinder;

(b) said cylinder has a piston rod connected to a rack which is meshed with said gears; and (c) means connected to said rack for controlling the backlash between said rack and said gears.

4. In apparatus according to claim 1 further characterized in that:

(a) each driven shaft is provided with a gear of the same diameter;

(b) said drive mechanism is provided with a piston and cylinder; and (c) said piston actuates a piston rod connected to a rack meshed with said gears.

* * * * *